US012426764B2

(12) United States Patent
Bailey et al.

(10) Patent No.: US 12,426,764 B2
(45) Date of Patent: Sep. 30, 2025

(54) CLEANING TOOL ARRANGEMENT FOR ELECTROMECHANICAL DEVICES

(71) Applicant: KICTeam, Inc., Auburn, ME (US)

(72) Inventors: Glen Bailey, Litchfield, ME (US); John Condon, Summer, ME (US); Geoffrey Scott Caron, Sabattus, ME (US); Joshua Larsen, Turner, ME (US)

(73) Assignee: KICTeam, Inc., Auburn, ME (US)

( * ) Notice: Subject to any disclaimer, the term of this patent is extended or adjusted under 35 U.S.C. 154(b) by 160 days.

(21) Appl. No.: 18/446,759

(22) Filed: Aug. 9, 2023

(65) Prior Publication Data

US 2023/0380650 A1 Nov. 30, 2023

Related U.S. Application Data

(63) Continuation of application No. 17/082,503, filed on Oct. 28, 2020, now Pat. No. 11,805,955, which is a continuation-in-part of application No. 16/003,551, filed on Jun. 8, 2018, now Pat. No. 10,849,479.

(51) Int. Cl.

| | |
|---|---|
| ***A47L 13/46*** | (2006.01) |
| ***A47L 13/08*** | (2006.01) |
| ***A47L 13/12*** | (2006.01) |
| ***A47L 13/17*** | (2006.01) |
| ***A47L 13/51*** | (2006.01) |

(52) U.S. Cl.

CPC ..... *A47L 13/46* (2013.01); *A47L 13/08* (2013.01); *A47L 13/12* (2013.01); *A47L 13/17* (2013.01); *A47L 13/51* (2013.01)

(58) Field of Classification Search

CPC ..... A47L 13/38; A47L 13/44; A47L 13/46; A47L 13/256–257; A47L 13/17; A47L 13/12; A47L 13/16; A47L 13/08

USPC ..... 15/104.93–104.94, 229.4, 229.8, 231

See application file for complete search history.

(56) References Cited

U.S. PATENT DOCUMENTS

| | | | | |
|---|---|---|---|---|
| 1,437,145 | A * | 11/1922 | Johnson | A47L 13/38 15/210.1 |
| 2,775,246 | A | 12/1956 | Morrel | |
| 5,044,383 | A | 9/1991 | Alessio et al. | |
| 5,133,971 | A | 7/1992 | Copelan et al. | |

(Continued)

FOREIGN PATENT DOCUMENTS

| | | |
|---|---|---|
| JP | 4-294746 | 10/1992 |

OTHER PUBLICATIONS

Markertek website, https://www.markertek.com/product/cs25/chemswab-presaturated-25-swab-pack?utm_medium=shoppingengine&utm_source=googlebase&gclid=CJW . . . , downloaded Dec. 7, 2017.

*Primary Examiner* — Laura C Guidotti

(74) *Attorney, Agent, or Firm* — Fox Rothschild LLP

(57) ABSTRACT

A cleaning tool arrangement for cleaning internal components of electromechanical devices, including a cleaning tool having a flexible, resilient rod having a first end, a second end, and a lateral dimension, as well as a scraper fin, wherein the scraper fin extends away from the rod in a direction that is perpendicular to the lateral dimension of the rod. The cleaning tool also includes a cleaning head attached to the first end of the rod and extending away from the rod, the cleaning head being pre-saturated with a cleaning solution. Additionally, the cleaning tool arrangement includes a sealed wrapper that is sized and configured to enclose at least the cleaning head.

7 Claims, 11 Drawing Sheets

(56) References Cited

U.S. PATENT DOCUMENTS

| | | | | |
|---|---|---|---|---|
| 5,671,498 | A * | 9/1997 | Martin | A47K 7/03 15/118 |
| 6,185,778 | B1 | 2/2001 | Ornstedt | |
| 7,546,657 | B2 | 6/2009 | Gurley | |
| 7,966,687 | B2 | 6/2011 | Rahbar-Dehghan | |
| 8,327,493 | B2 | 12/2012 | Armaly, Jr. | |
| 8,763,616 | B2 * | 7/2014 | Koptis | B65D 73/0071 15/104.001 |
| 10,849,479 | B2 | 12/2020 | Bailey et al. | |
| 2003/0024541 | A1 | 2/2003 | Shum | |
| 2007/0074360 | A1 | 4/2007 | Gurley | |
| 2007/0163063 | A1 | 7/2007 | Wright | |
| 2009/0090376 | A1 | 4/2009 | Wang | |
| 2010/0313376 | A1 | 12/2010 | Hong | |
| 2012/0283616 | A1 | 11/2012 | Edme et al. | |
| 2013/0327357 | A1 | 12/2013 | Muhr-Sweeney | |
| 2015/0101137 | A1 | 4/2015 | Xu | |

* cited by examiner

CLEANING TOOL ARRANGEMENT FOR ELECTROMECHANICAL DEVICES

RELATED APPLICATIONS AND CLAIM OF PRIORITY

This application is a continuation of, and claims priority to, U.S. patent application Ser. No. 17/082,503, filed Oct. 28, 2020, which is a continuation-in-part of U.S. patent application Ser. No. 16/003,551, filed Jun. 8, 2018, issued as U.S. Pat. No. 10,849,479 on Dec. 1, 2020.

BACKGROUND

Electromechanical devices that accept or dispense printed media, such as, e.g., automated teller machines that accept printed media, slot machines and other gaming machines, manufacturing equipment, and even print devices typically contain a complex set of internal sensors and mechanical parts to move the printed media into the device, out of the device, and/or through various processing steps within the device. The movement of printed media through such devices can cause dirt and oils to build-up on the devices' drive wheels, belts, and sensors of the devices' media transport mechanisms. Thus, periodic cleaning of such devices is an important preventative maintenance step. However, because consumers desire that these devices have a small footprint, these electromechanical components must fit into a very small space. This makes cleaning the internal components a particular challenge, as it can be difficult to access many of the components that should be cleaned.

While cleaning tools have been developed in an attempt to clean various spaces on or within electromechanical devices, these tools have been unable to both reach and clean all desired spaces. Alternatively or additionally, these cleaning tools have been awkward for the user to manipulate as they clean various surfaces and/or components. For example, cleaning tools having a soft cleaning head at one end and a chisel at an opposite end have been used. However, due to the varying angles of entry, sizes of openings, and levels of dirt and/or oil build-up within various spaces on the electromechanical devices, these cleaning tools have proven inadequate and/or inefficient.

This document describes new tools for use in addressing some or all of the issues described above.

SUMMARY

In accordance with an aspect of the disclosure, a cleaning tool arrangement for cleaning internal components of electromechanical devices includes a cleaning tool. The cleaning tool includes a flexible, resilient rod having a first end, a second end, and a lateral dimension. The tool also includes a scraper fin that extends from, or is attached to, the rod. The scraper fin extends away from the rod in a direction that is perpendicular to the lateral dimension of the rod. The tool also includes a cleaning head attached to the first end of the rod and extending away from the rod. The cleaning head includes a first face on which an abrasive scrubbing material is disposed, and a second face (located opposite the first face) comprising a soft cleaning material. The cleaning head is sized and configured to fit inside of an electromechanical device. The cleaning head is pre-saturated with a cleaning solution. The arrangement also includes a sealed wrapper that is sized and configured to enclose at least the cleaning head.

Optionally, the soft cleaning material may include a sponge and may be pre-saturated with the cleaning solution in an amount that does not freely drip from the sponge. Also optionally, an exterior surface of the sponge may be covered by a fabric material.

Optionally, a chisel may extend from the second end of the rod, wherein the chisel extends away from the rod in a direction that is parallel to the lateral dimension of the rod.

In another arrangement, a cleaning tool arrangement for cleaning internal components of electromechanical devices includes a cleaning tool. The cleaning tool includes a flexible, resilient rod having a first end, a second end, and a lateral dimension. The cleaning tool also includes a scraper fin that extends from or is attached to the rod and extends away from the rod in a direction that is perpendicular to the lateral dimension of the rod. The cleaning tool includes a chisel extending from the second end of the rod, wherein the chisel extends away from the rod in a direction that is parallel to the lateral dimension of the rod. A cleaning head is attached to the first end of the rod and extending away from the rod. The cleaning head is sized and configured to fit inside of an electromechanical device. The cleaning head is pre-saturated with a cleaning solution. The arrangement also includes a sealed wrapper that is sized and configured to enclose at least the cleaning head.

In either embodiment:

Optionally, the rod may be formed of at least polypropylene and calcium carbonate.

Optionally, the cleaning solution may include an alcohol-free solution.

Optionally, the sealed wrapper may enclose both the rod and the cleaning head. Alternatively, the sealed wrapper may enclose only the cleaning head.

Optionally, at least a portion of the sealed wrapper may be formed of a foil material.

DETAILED DESCRIPTION

The following description is made for the purpose of illustrating the general principles of the present devices and/or methods and is not meant to limit the inventive concepts claimed in this document. Further, particular features described in this document can be used in combination with other described features in each of the various possible combinations and permutations.

Unless otherwise specifically defined in this document, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an" and "the" include plural referents unless otherwise specified. Unless defined otherwise, all technical and scientific terms used herein have the same meanings as commonly understood by one of ordinary skill in the art. All publications mentioned in this document are incorporated by reference. Nothing in this document is to be construed as an admission that the embodiments described in this document are not entitled to antedate such disclosure by virtue of prior invention. As used herein, the term "comprising" means "including, but not limited to". Additionally, use the term "couple", "coupled", or "coupled to" may imply that two or more elements may be directly connected or may be indirectly coupled through one or more intervening elements.

In this document, position-identifying terms such as "distal", "proximal", "vertical", "horizontal", "front", "rear", "side", "top", and "bottom" are not intended to limit the invention to a particular direction or orientation, but instead are only intended to denote relative positions, or positions corresponding to directions shown when a cleaning tool is oriented as shown in the Figures.

Figure 1:
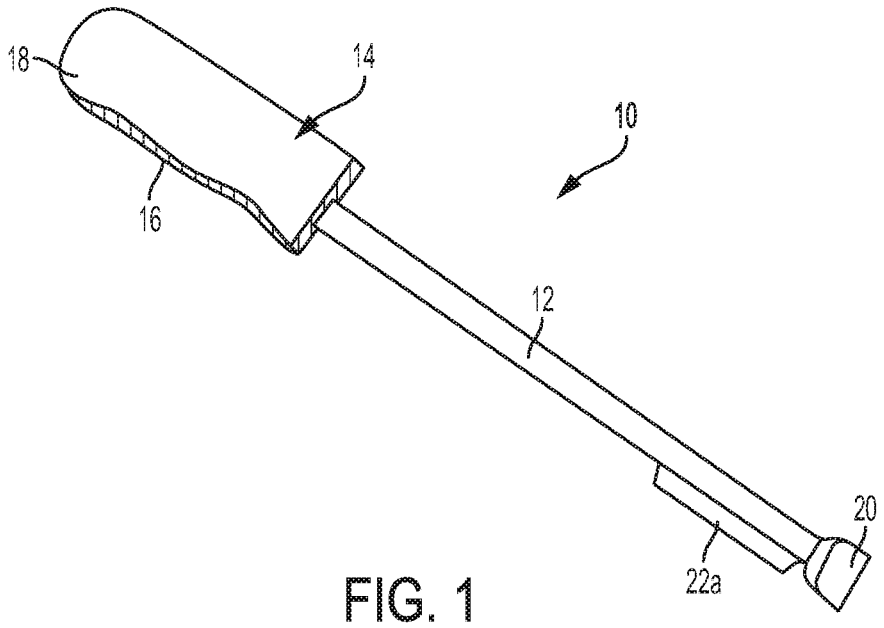
FIG. 1 illustrates a top plan view of a cleaning tool in accordance with an aspect of the disclosure.
Figure 2:
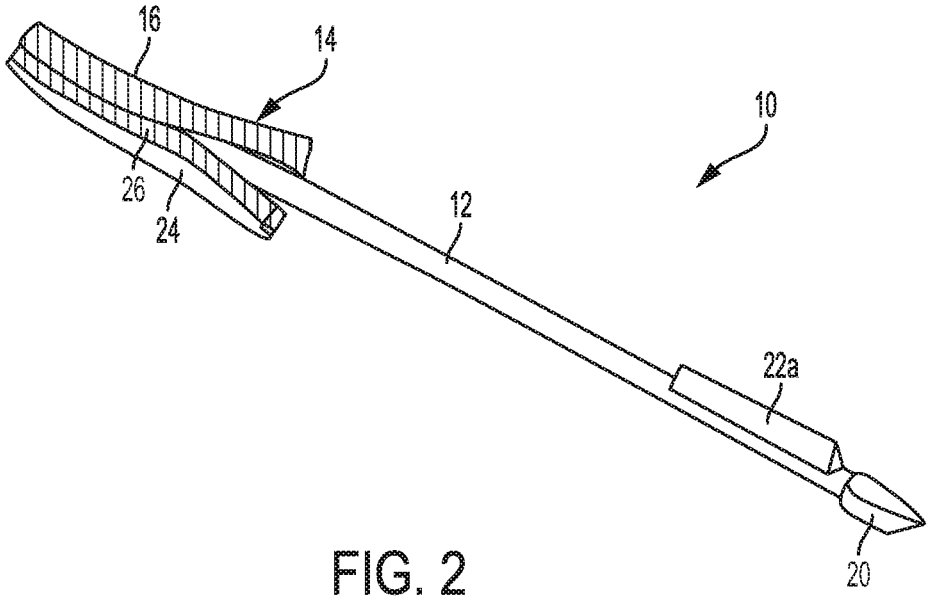
FIG. 2 illustrates a side view of the cleaning tool of FIG. 1.
Figure 3:
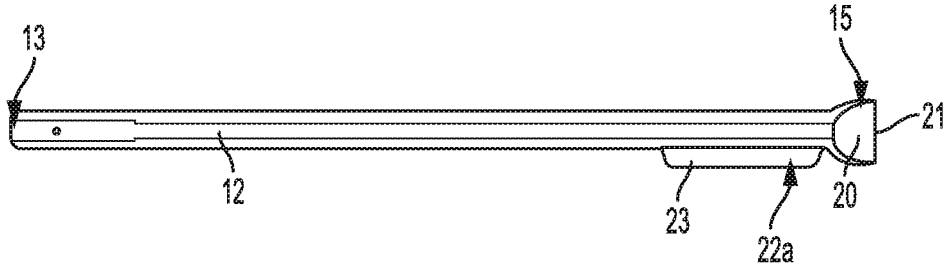
FIG. 3 illustrates a partial top view of an end of the cleaning tool of FIG. 1.

Referring to FIGS. 1-5, a cleaning tool 10 in accordance with an aspect of the disclosure is illustrated. Cleaning tool 10 includes an elongated, flexible rod 12 having a first end 13 and a second end 15, as shown in FIG. 3. Rod 12 of cleaning tool 10 may be formed of any appropriate material having a hardness level sufficient for a cleaning operation (e.g., scraping, light prying, etc.), yet flexible enough to allow for rod 12 to be temporarily formed or bent in various directions, thereby allowing portions of cleaning tool 10 to reach areas within a device that might otherwise be inaccessible. Additionally, rod 12 is formed of a resilient material, thereby allowing rod 12 to return to its original shape and/or orientation after being bent in various directions. For example, rod 12 may be formed of a combined polypropylene and calcium carbonate filler material, which allows rod 12 to be bent and temporarily fixed at a given angle during a cleaning operation. However, when the cleaning operation is complete, or a different cleaning operation is needed, rod 12 may be bent to return to its original, straight position. While a combined polypropylene and calcium carbonate filler material is used in the example above, it is to be understood that rod 12 may be formed of other appropriate material(s) in accordance with aspects of the disclosure.

Figure 4:
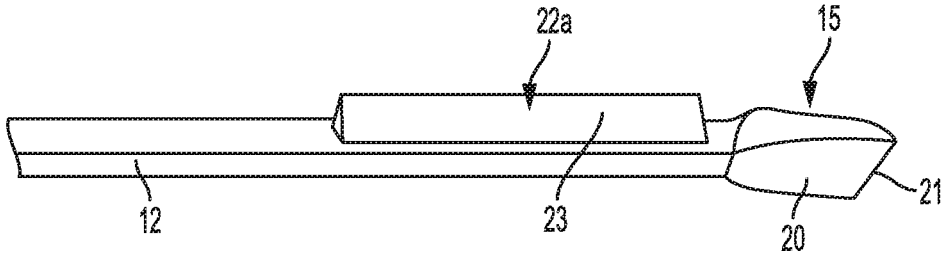
FIG. 4 illustrates a partial side view of an end of the cleaning tool of FIG. 1.

Proximate to second end 15 of rod 12, cleaning tool 10 may include chisel 20 and a scraper fin 22. As shown in FIGS. 3-4, chisel 20 is disposed on second end 15 and is shaped to have a pair of faces converging to form a substantially sharp scraping edge 21. Chisel 20 may also be shaped so as to have a face wider than the diameter of rod 12, thereby providing scraping edge 21 with an increased width relative to the diameter of rod 12. With this configuration, cleaning tool 10 may be moved in an axial direction relative to rod 12 in order to provide a chiseling or scraping effect on the surface to be cleaned. Additionally, as the chisel 20 is angled to converge at scraping edge 21, chisel 20 may be utilized to access hard-to-reach areas of the device to be cleaned.

Referring still to FIGS. 3-4, scraper fin 22*a* is shown as extending longitudinally a certain distance along a side surface of rod 12 away from second end 15. For example, scraper fin 22*a* may extend, e.g., 1¼ inches, along a side surface of rod 12. It is to be understood that scraper fin 22*a* could extend any appropriate length, and could be shorter or longer than that which is illustrated in FIGS. 1-5. Scraper fin 22*a* is configured to taper to a substantially sharp edge 23 at a location laterally offset from rod 12. With this configuration, cleaning tool 10 may be moved in a lateral direction relative to rod 12 in order to provide a scraping effect on the surface to be cleaned, allowing for even greater utility in cleaning hard-to-reach areas and/or surface of the device.

In accordance with another aspect of the disclosure, instead of having both an independent chisel 20 and an independent scraper fin 22*a*, cleaning tool 10 may incorporate a single, continuous scraping surface which transitions from the end of rod 12 to a side surface of rod 12. Additionally and/or alternatively, while not shown, one or more of the scraping surfaces (e.g., chisel 20 and/or scraper fin 22) may be angled relative to rod 12, similar to the tool head angles of a shovel or hoe. With such a configuration, the scraping surface(s) may more effectively access hard-to-reach areas within the device.

Figure 5:
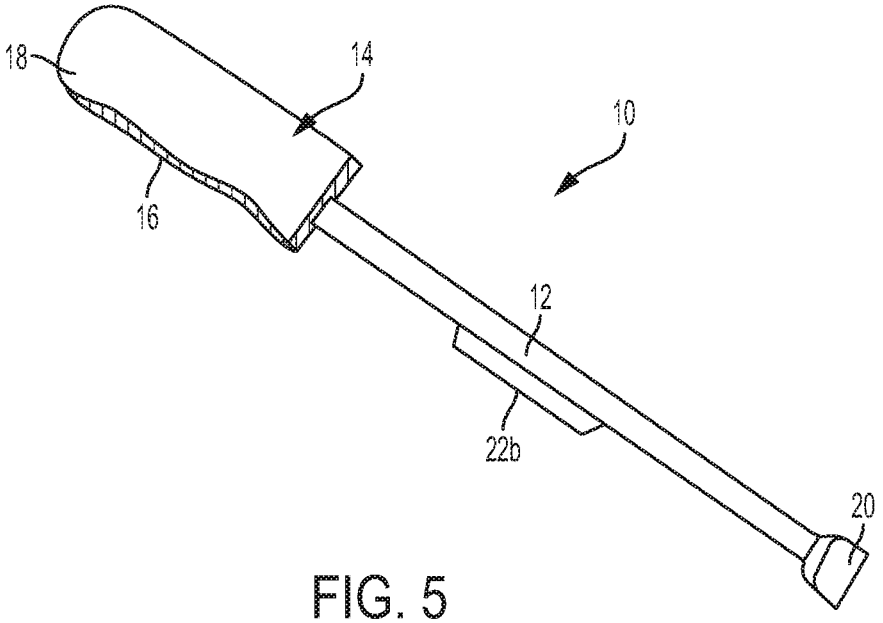
FIGS. 5 and 6 are views that illustrate a first alternate position of a scraper fin on the cleaning tool.
Figure 6:
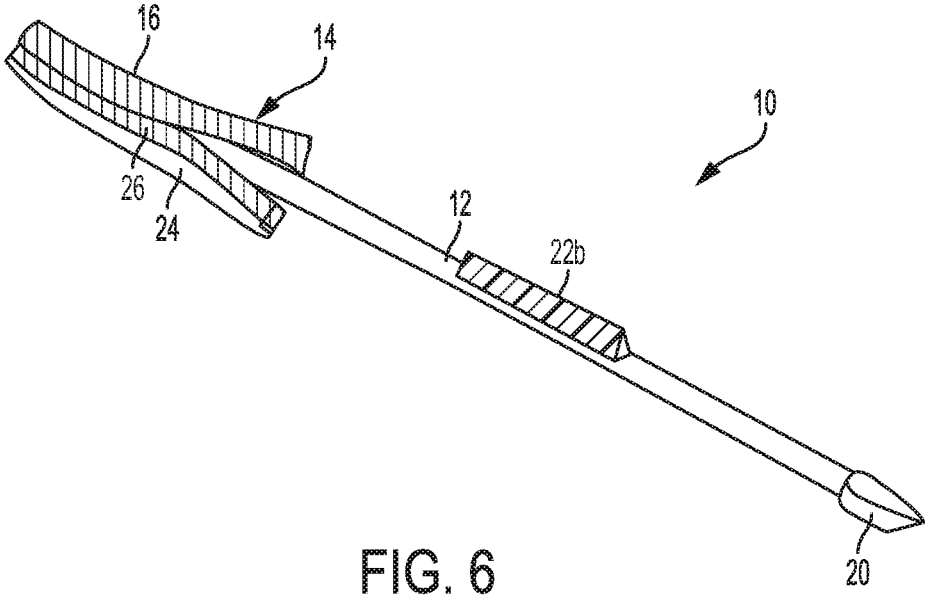
Figure 7:
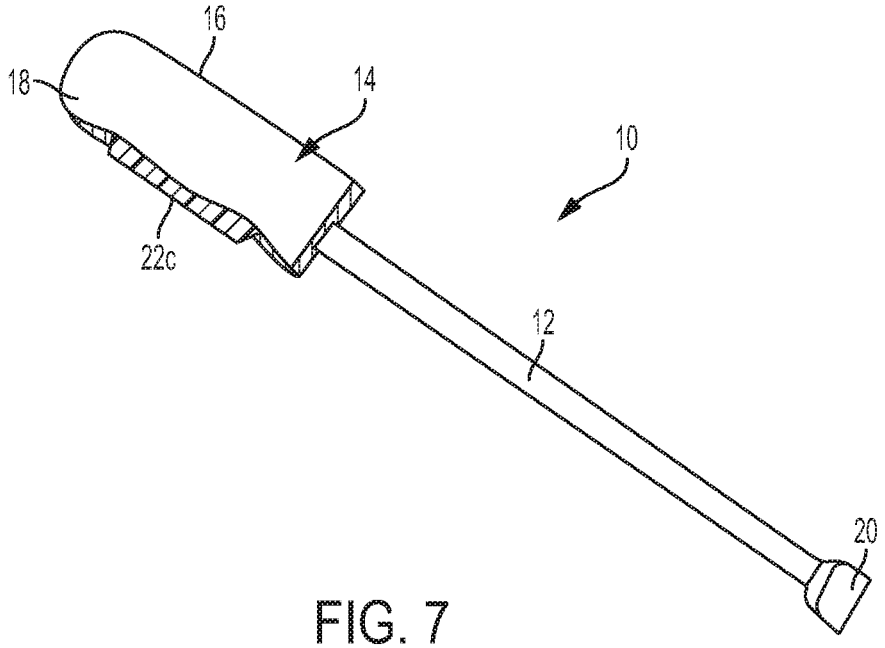
FIGS. 7 and 8 are views that illustrate a second alternate position of a scraper fin on the cleaning tool.
Figure 8:
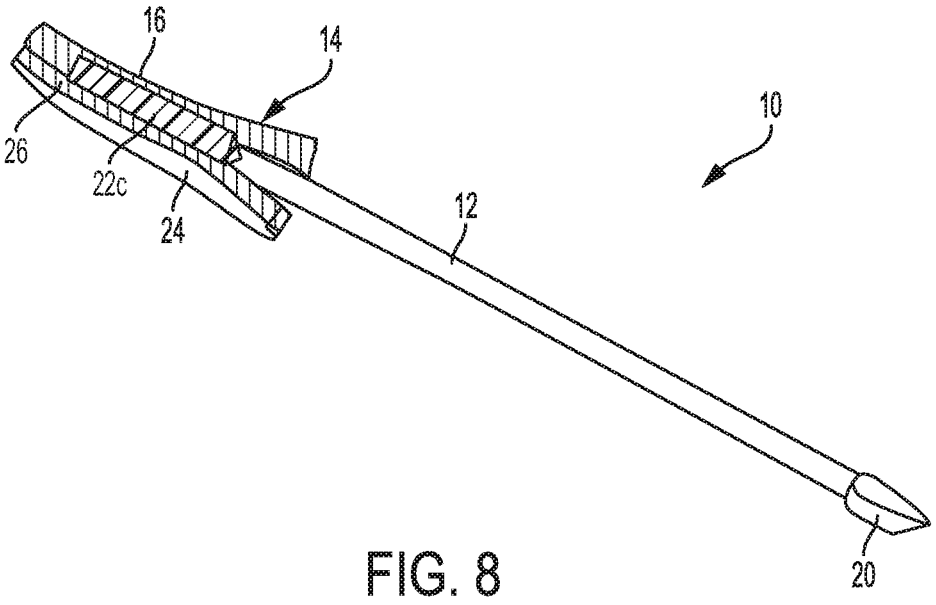

FIG. 4 illustrates an embodiment in which scraper fin 22*a* is positioned proximate to the end of the second end 15 of the rod 12. However, the invention is not limited in this regard. FIGS. 5 and 6 illustrate a variation in which scraper fin 22*b* is positioned anywhere along the rod 12, such as centrally located between the first and second ends. FIGS. 7 and 8 illustrates a variation in which scraper fin 22*c* is positioned proximate to the end of the first end 15 of the rod 12 (which is covered by cleaning head 14, described in more detail below). In this embodiment, scraper fin 22*c* may extend outwardly from the rod 12 beyond one side of cleaning head 14.

Referring again to FIGS. 1-2 (and also FIGS. 5-8), cleaning tool 10 further includes a cleaning head 14. Cleaning head 14 may be configured to be removably attachable to the first end 13 of rod 12. Accordingly, cleaning head 14 may be removed and/or replaced by the user when soiled, worn, etc. Cleaning head 14 is sized to extend longitudinally along rod 12 a distance sufficient to provide a wider cleaning surface. For example, in accordance with one aspect of the disclosure, cleaning head 14 may be approximately 2 inches in length and approximately ¾ inches in width, allowing cleaning head 14 to contact a substantial surface area for wiping, scrubbing, etc., while still maintaining a sufficiently compact size to fit into and between various component parts of the electromechanical device. Additionally, cleaning head 14 may have a rounded distal end 18, which may enable cleaning head 14 to better access cylindrical and/or otherwise curved surfaces. However, it is to be understood that cleaning head 14 may be of any appropriate size and/or shape, and is not limited to the examples shown and described with respect to FIGS. 1-2 and 5-8.

As shown in FIG. 2, cleaning head 14 may have a first cleaning face 16 and a second cleaning face 24, with first cleaning face 16 and second cleaning face 24 being disposed on opposing sides of cleaning head 14. In some aspects of the disclosure, first cleaning face 16 and second cleaning face 24 may each have different surface textures for use in different cleaning operations. For example, first cleaning face 16 may include a material having an abrasive surface for use in scrubbing, while second cleaning face 24 may include a soft material having absorbent characteristics for wiping and/or washing surfaces. The soft material of the second cleaning face 24 may include an absorbent sponge. An exterior surface of second cleaning face 24 may be covered with a fabric material, which may be configured to protect the absorbent sponge material. With such a configuration, cleaning head 14 may be used for varying cleaning operations. Alternatively, first cleaning face 16 and second cleaning face 24 may be formed of the same material.

While not shown in FIGS. 1-2, cleaning head 14 may also be pre-saturated with an alcohol-free cleaning solution for use in cleaning various surfaces of the device. Cleaning head 14 may include an absorbent core 26 sandwiched between first cleaning face 16 and second cleaning face 24, which allows for the absorption of the alcohol-free cleaning solution. In some embodiments, absorbent core 26 may be formed of a sponge material. A fabric material may be disposed on an exterior surface of absorbent core 26 in order to provide protection to the sponge material. The cleaning solution may then be delivered to (and through), e.g., the second cleaning face 24 during a cleaning operation so as to better remove debris and build-up from the surfaces to be cleaned. The amount of cleaning solution used to pre-saturate the cleaning head 14 prior to a cleaning operation is large enough that cleaning solution is able to at least coat the second cleaning face 24 when absorbent core 26 is at least partially compressed, yet not so large as to allow cleaning solution to freely drip from cleaning head 14, even if absorbent core 26 is compressed.

Also, while not shown in FIGS. 1-7, cleaning head 14 may be angled with respect to rod 12 so as to provide for increased capabilities in cleaning hard-to-reach areas of the device. The angled cleaning head 14 may be permanently fixed in the angled position, or, as described above, may be temporarily angled into a desired position due to the relative pliability of rod 12.

Figure 9:
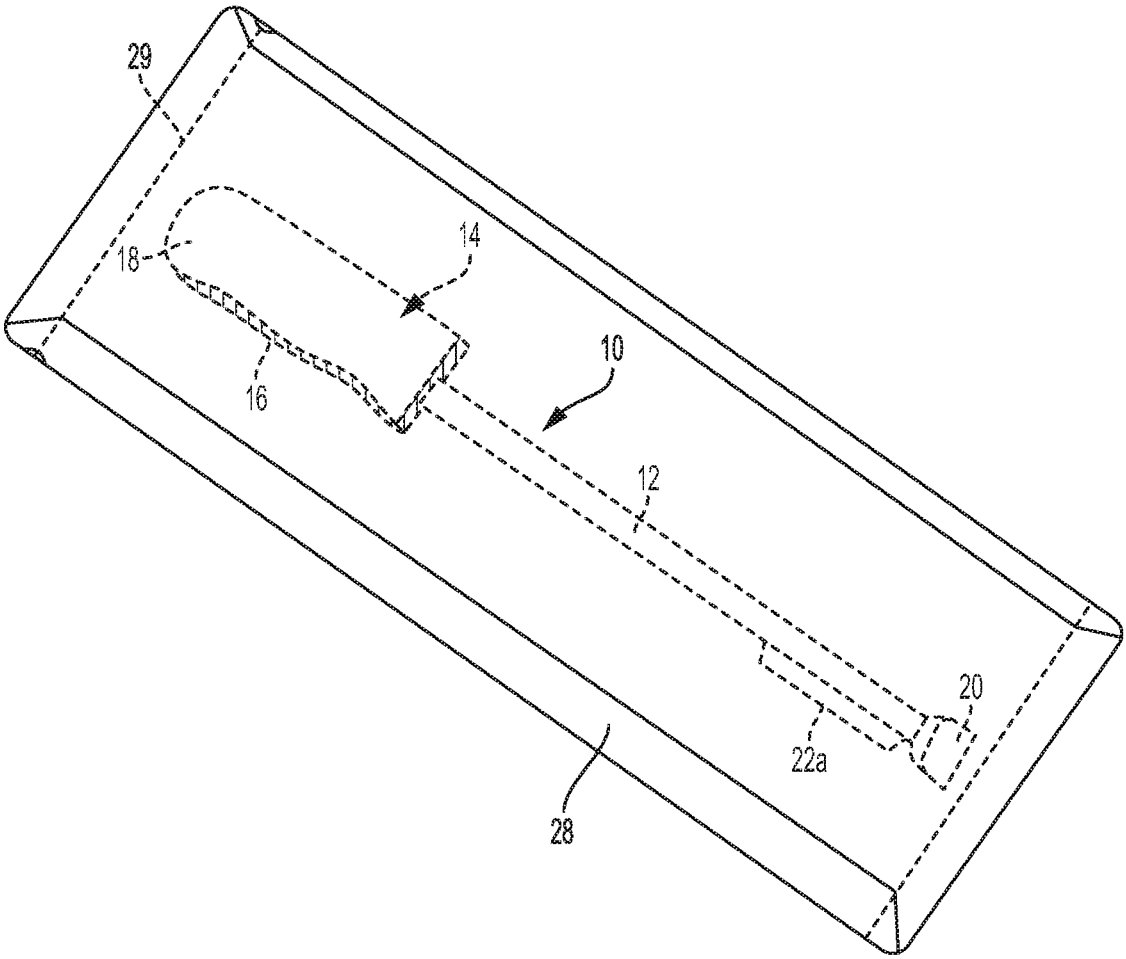
FIG. 9 illustrates a top perspective view of a cleaning tool with components arranged within a sealed wrapper.

Referring to FIG. 9, cleaning tool 10 is shown as being environmentally sealed within a pouch or wrapper 28. As noted above, some or all of cleaning head 14 may be pre-saturated with a cleaning solution (e.g., an alcohol-free cleaning solution). In order to prevent significant evaporation of the cleaning solution prior to use, cleaning tool 10 may be packaged and sealed within wrapper 28. When a user desires to use cleaning tool 10 for a cleaning operation, the user may tear or otherwise open wrapper 28 at an opening location 29, thereby providing the user with access into the wrapper 28 to remove cleaning tool 10. In order to avoid leakage of the cleaning solution and/or entry of air or other contaminants into the wrapper 28, at least a portion of the wrapper 28 may be formed of a substantially non-porous, airtight material such as, e.g., a foil material.

Figure 10:
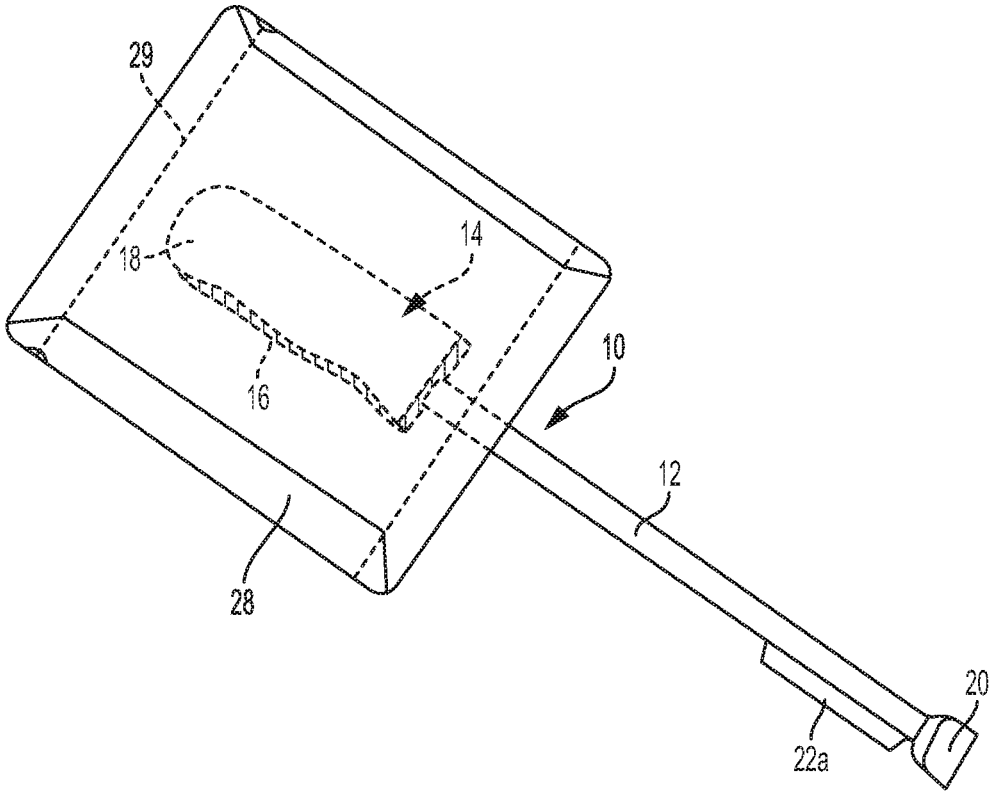
FIG. 10 illustrates a top perspective view of a cleaning tool arranged within an alternate sealed wrapper

While illustrated in FIG. 9 as fully enclosing the entirety of cleaning tool 10, in accordance with alternative aspects of the disclosure, it is to be understood that wrapper 28 could enclose fewer than all elements of cleaning tool 10. For example, as shown in FIG. 10, wrapper 28 could be configured to enclose and seal only cleaning head 14, leaving a length of rod 12 exposed and accessible. In such a configuration, the wrapper 28 would still prevent or inhibit evaporation of the pre-saturated cleaning solution within the cleaning head 14, while reducing the amount of packaging and avoiding the possible spread of cleaning solution to, e.g., the surfaces of rod 12, chisel 20, and/or scraper fin 22, where it may be unnecessary and/or undesirable.

Figure 11:
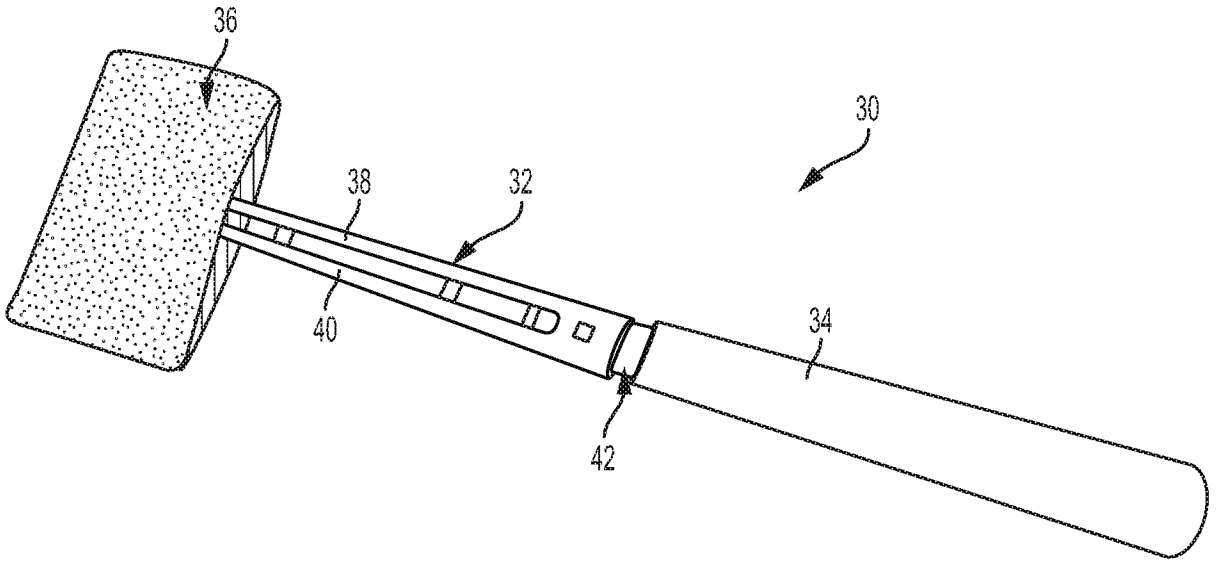
FIG. 11 illustrates a top plan view of a cleaning tool in accordance with another aspect of the disclosure.
Figure 12:
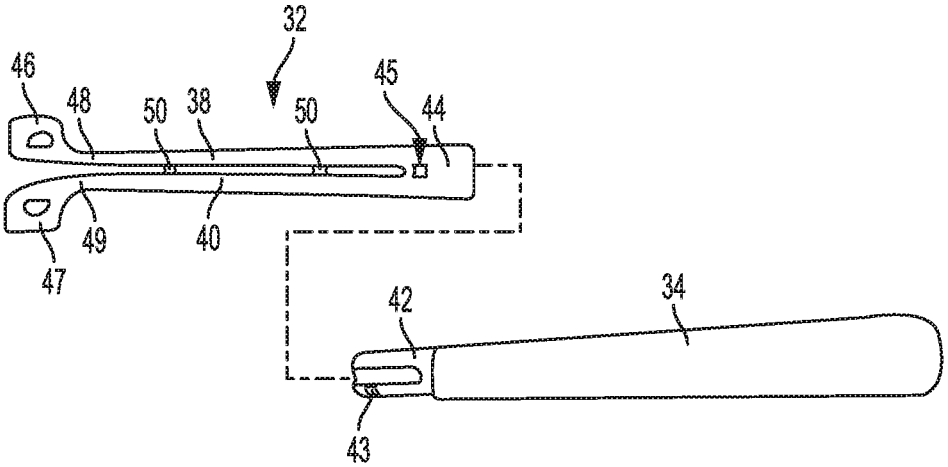
FIG. 12 illustrates a top view of a detached cleaning head and handle of the cleaning tool of FIG. 11.
Figure 13:
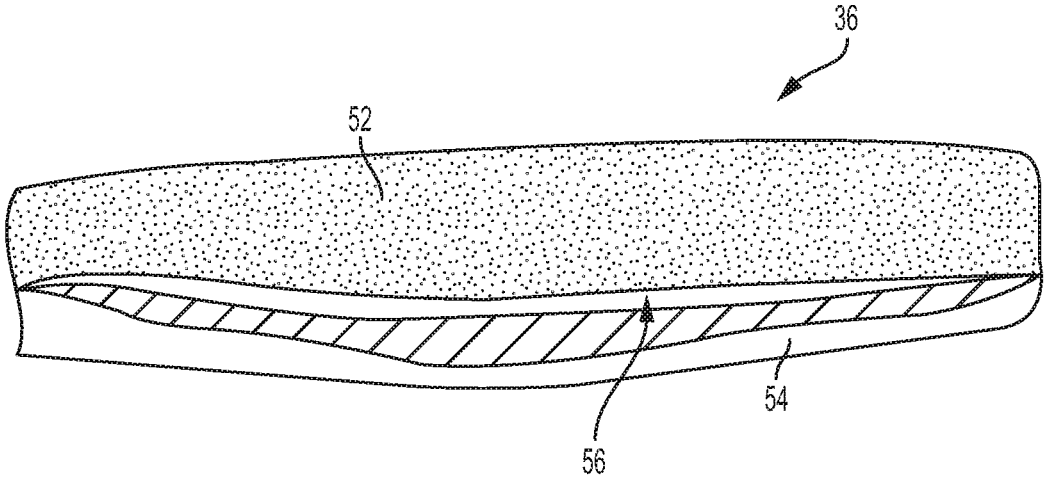
FIG. 13 illustrates a bottom view of a cleaning pad for use with the cleaning tool of FIG. 11.

Next, referring to FIGS. 11-13, a cleaning tool 30 in accordance with another aspect of the disclosure is illustrated. Cleaning tool 30 includes a rod portion 32 having a first end configured to retain a cleaning head 36 and a second end configured to be removably coupled to a handle 34. Similar to cleaning tool 10 described above, rod portion 32 may be formed of any appropriate material having a hardness level sufficient for a cleaning operation (e.g., scraping, light prying, etc.), yet have regions flexible enough to allow for at least a portion or portions of rod portion 32 to be temporarily bent in order to reach areas within a device that might otherwise be inaccessible. For example, rod portion 32 may be formed of a combined polypropylene and calcium carbonate filler material. However, rod portion 32 is not limited to such a material and may be formed of any suitable material, including materials having more or less flexible properties. Furthermore, handle 34 may be formed of the same or different material as rod portion 32, as handle 34 does not necessarily need to have flexibility.

As shown in FIG. 12, rod portion 32 includes a pair of flexible, resilient stems 38, 40 extending from a second end portion 44, wherein second end portion 44 is configured at least partially as an open cylindrical connector for coupling to handle 34 via a connection interface 42. Interposed between the pair of stems 38, 40 at various points along the length of rod portion 32 are a plurality of cross braces 50, which may be affixed or integrally formed with stems 38, 40 to prevent movement between stems 38, 40 along a particular length of rod portion 32.

However, in the direction of the first end of rod portion 32 and distally beyond the cross braces 50, stems 38, 40 each comprise respective resilient stem portions 48, 49. Resilient stem portions 48, 49 are configured to angle at least partially away from one another, forming a substantially V-shaped end portion to rod portion 32. On the distal end of each of resilient stem portions 48, 49 is a respective prong 46, 47, which is sized and shaped to fit within and hold cleaning head 36, as will be described further below. Each prong 46, 47 extends away from the respective stem portions 48, 49 in a direction that is substantially perpendicular to the lateral dimension of the rod portion 32. With such a configuration, when the stem portions 48, 49 are at rest, the prongs 46, 47 form a width corresponding to an expanded position. Conversely, when the stem portions 48, 49 are compressed, prongs 46, 47 form a width that is less than that of the expanded position.

In order to removably attach cleaning head 36 to rod portion 32, the user may compress flexible, resilient stem portions 48, 49 toward one another, thereby moving prongs 46, 47 closer to one another, as well. With prongs 46, 47 in such a position as held by the user, prongs 46, 47 may be inserted into a pocket 56 of cleaning head 36 (as shown in FIG. 13), with pocket 56 having an opening width wider than the width of prongs 46, 47 in the compressed position. Once prongs 46, 47 are at least partially disposed within pocket 56, the user may release flexible, resilient stem portions 48, 49, thereby causing prongs 46, 47 to move away from one another within pocket 56. The peripheral edge surfaces of prongs 46, 47 are thereby urged against at least some of the internal surfaces of pocket 56, which allows cleaning head 36 to be securely retained on the first end of rod portion 32. In order to remove cleaning head 36, the user simply must again squeeze flexible, resilient stem portions 48, 49 to release the peripheral edge surfaces of prongs 46, 47 from the internal surfaces of pocket 56. While not shown in FIG. 7, the peripheral edge surfaces of prongs 46, 47 may be utilized as scraping surfaces when the cleaning head 36 is removed from rod portion 32, thereby providing additional cleaning functionality to cleaning tool 30.

As described above, rod portion 32 may be configured to be removably attachable to handle 34 via interaction between the connection interface 42 on handle 34 and second end portion 44 of rod portion 32. Specifically, connection interface 42 of handle 34 may include a flexible tab 43 capable of interlocking engagement with a receiver 45 at or near second end portion 44. When the user wishes to remove rod portion 32 from handle 34, the user need only press inwardly upon flexible tab 43 through the receiver 45 to release the flexible tab 43 from the receiver 45. While not shown, in accordance with an alternative aspect of the disclosure, handle 34 may be integrally formed with rod portion 32 (i.e., non-removable from rod portion 32).

Similar to cleaning head 14 described above with respect to FIGS. 1-5, as shown in FIG. 11, cleaning head 36 may have a first cleaning face 52 and a second cleaning face 54, with first cleaning face 52 and second cleaning face 54 being disposed on opposing sides of cleaning head 36. First cleaning face 52 and a second cleaning face 54 may each have different surface textures for use in different cleaning operations. For example, first cleaning face 52 may include a material having an abrasive surface for use in scrubbing, while second cleaning face 54 may include a soft material having absorbent characteristics for wiping and/or washing surfaces. Alternatively, first cleaning face 52 and second cleaning face 54 may be formed of the same material. As cleaning heads 36 are configured to be removable, various materials having various cleaning characteristics may be utilized for different cleaning heads 36, with the user choosing a cleaning head 36 suitable to a particular cleaning operation.

Furthermore, similar to cleaning head 14, cleaning head (s) 36 may also be pre-saturated with an alcohol-free cleaning solution for use in cleaning various surfaces of the device. Additionally and/or alternatively, in order to prevent significant evaporation of the alcohol-free cleaning solution prior to use, cleaning tool 30 and/or removable cleaning head(s) 36 may be packaged in an environmentally-sealed bag or container.

Figure 14:
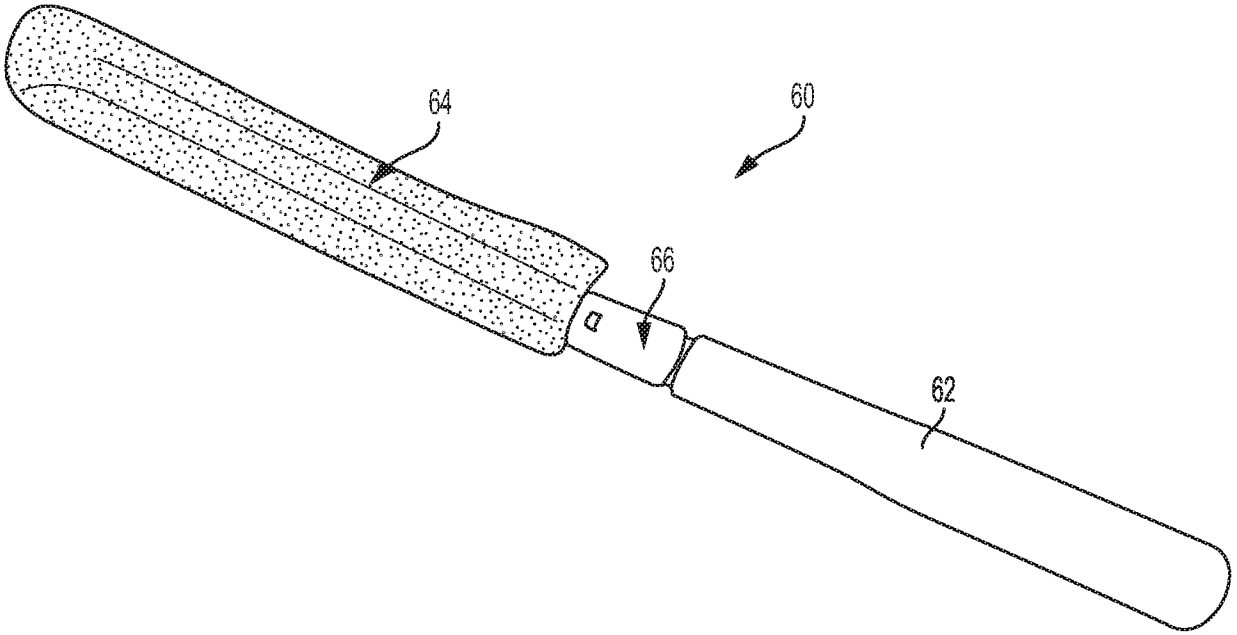
FIG. 14 illustrates a top plan view of a cleaning tool in accordance with another aspect of the disclosure.
Figure 15:
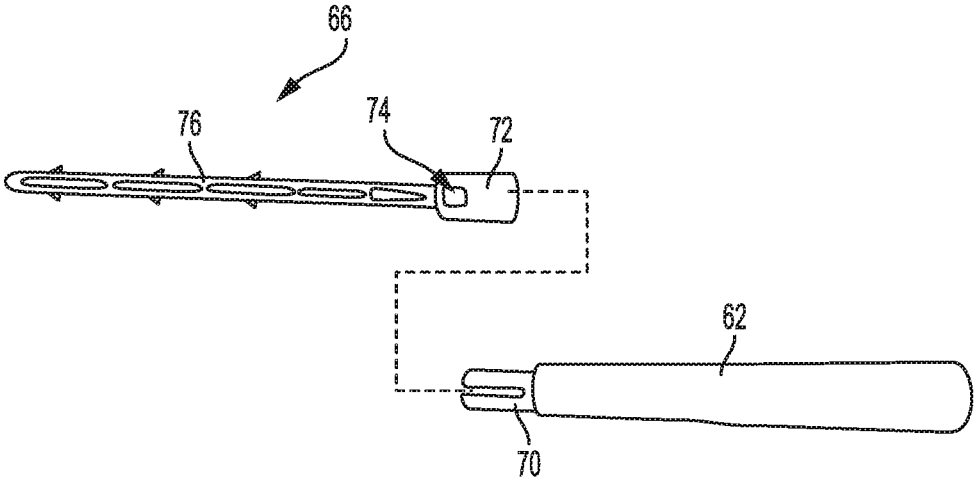
FIG. 15 illustrates a top view of a detached cleaning head and handle of the cleaning tool of FIG. 14.
Figure 16:
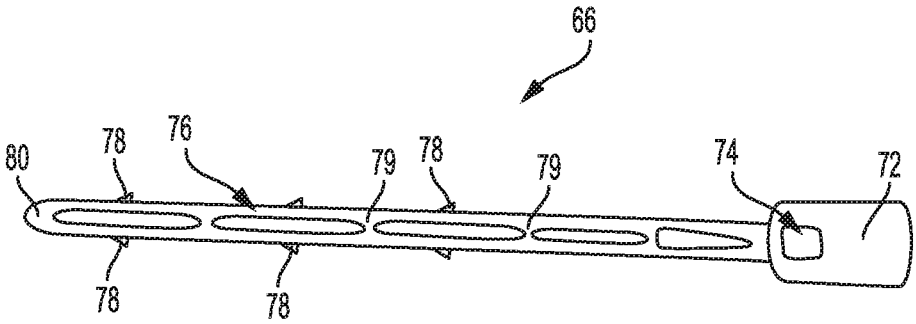
FIG. 16 illustrates a top view of a detached cleaning head of the cleaning tool of FIG. 14.

Next, referring to FIGS. 14-16, a cleaning tool 60 in accordance with another aspect of the disclosure is shown. Cleaning tool 60 includes an elongated rod portion 66 having a first end configured to retain an elongated cleaning head 64 and a second end configured to be removably coupled to a handle 62. As shown in FIG. 15, elongated rod portion 66 includes an elongated stem portion 76 having respective side surfaces interconnected via a plurality of cross braces 79. A first, distal end of elongated rod portion 66 includes a substantially rounded end 80, while a second, proximal end portion 72 of elongated rod portion 66 is configured at least partially as an open cylindrical connector for coupling to handle 62 via a connection interface 70.

Similar to the interconnection described above with respect to cleaning tool 30, elongated rod portion 66 may be configured to be removably attachable to handle 62 via interaction between a connection interface on handle 62 and second end portion 74 of elongated rod portion 66. Specifically, the connection interface of handle 62 may include a flexible tab 70 capable of interlocking engagement with a receiver 74 at or near second end portion 72. When the user wishes to remove elongated rod portion 66 from handle 62, the user need only press inwardly upon flexible tab 70 through the receiver 74 to release the flexible tab 70 from the receiver 74. While not shown, in accordance with an alternative aspect of the disclosure, handle 62 may be integrally formed with elongated rod portion 66 (i.e., non-removable from elongated rod portion 66).

Referring to FIG. 16, elongated stem portion 76 of elongated rod portion 66 includes a plurality of spaced, angled ridges 78, wherein ridges 78 provide elongated stem portion 76 with a plurality of regions of increased width along the length of elongated stem portion 76. Ridges 78 are angled in such a way that the pocket (not shown) of a removable cleaning head 64 may be slid onto elongated stem portion 76 with only minimal resistance, thereby enabling the user to easily install a cleaning head 64 onto cleaning tool 60. However, due to the angular direction of ridges 78 and the interaction between the ridges 78 and the interior surface of the pocket of cleaning head 64, movement of the cleaning head 64 in the distal direction of elongated stem portion 76 is resisted. While the user is able to forcefully remove the cleaning head 64 from the elongated stem portion 76, the elongated stem portion 76 is configured to hold an installed cleaning head 64 substantially in place during a cleaning operation, thereby substantially preventing the cleaning head 64 from falling off of elongated stem portion 76 inadvertently.

While not shown in detail in FIG. 14, it is to be understood that cleaning head 64 may be configured similarly to cleaning heads 14 and/or 36 described above. Namely, cleaning head 64 may have a first cleaning face and a second cleaning face, with first cleaning face and second cleaning face being disposed on opposing sides of cleaning head, each having different respective surface textures for use in different cleaning operations. For example, the first cleaning face may include a material having an abrasive surface for use in scrubbing, while second cleaning face may include a soft material having absorbent characteristics for wiping and/or washing surfaces. Alternatively, cleaning head 64 may be formed of a single material. Furthermore, cleaning head(s) 64 may also be pre-saturated with an alcohol-free cleaning solution for use in cleaning various surfaces of the device. Additionally and/or alternatively, in order to prevent significant evaporation of the alcohol-free cleaning solution prior to use, cleaning tool 60 and/or removable cleaning head(s) 64 may be packaged in an environmentally-sealed bag or container.

Figure 17:
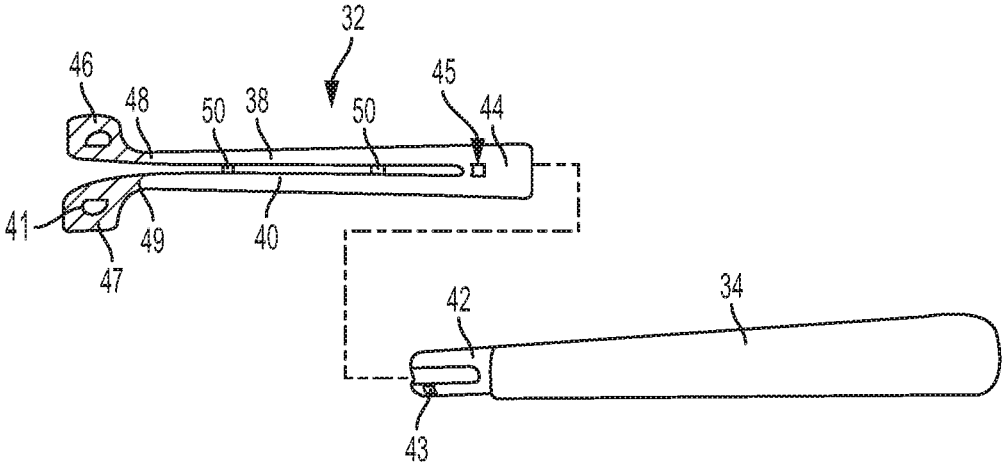
FIG. 17 illustrates a variation of a handle of the cleaning tool.

While not shown in any of FIGS. 1-16, cleaning tools having various alternative configurations are possible, including cleaning tools configured for use with the removable handle(s) as described above. For example, various attachments such as a vacuum attachment (including a nozzle, scraper, and/or brush), a duster head, an elongated scraper head, an elongated swap head, a powered rotating head, and/or a bendable/flexible head may be utilized in conjunction with the removable handle(s) described above. In addition, the segment of the tool that attaches to the removable cleaning head may include or be covered by a texture or resilient material that aids in attachment of the tool to the removable cleaning head. An example of this is shown in FIG. 17, in which on the tool of FIG. 12 the prongs 46, 47 of the rod portion 32 are covered by a hook-and-loop material 41 such as VELCRO®. Other featured materials, such as knobs, ridges, rubber material or other materials may be used.

Additionally and/or alternatively, the removable and/or disposable cleaning heads described above may have various alternative configurations. For example, the cleaning heads may have one or more surfaces having a washing material, a scrubbing/exfoliating material, a buffing material, a dusting material, a drying material, a sticky/adhesive material, and/or an anti-static coating depositing material. Accordingly, the removable cleaning heads may be chosen and interchanged based on specific cleaning needs within the device.

With the various configurable cleaning tools described above with respect to FIGS. 1-11, the cleaning of hard-to-reach locations within compact electromechanical devices, e.g., devices which accept and/or dispense printed media, is made possible without the need for substantial deconstruction of the devices.

The features and functions described above, as well as alternatives, may be combined into many other different systems or applications. Various alternatives, modifications, variations or improvements may be made by those skilled in the art, each of which is also intended to be encompassed by the disclosed embodiments.

The invention claimed is:

1. A cleaning tool for cleaning internal components of electromechanical devices, comprising:

a rod having a first end, a second end, and a lateral dimension, wherein:

the first end of the rod comprises a pair of flexible, resilient stems that extend from the rod to form a V-shape, each of the stems comprises a distal end with a prong that extends away from the stem in a direction that is substantially perpendicular to the lateral dimension of the rod, so that when the stems are at rest the prongs form a width corresponding to an expanded position and when the stems are compressed prongs form a width that is less than that of the expanded position, and each of the prongs comprises at least one chiseled edge; and a cleaning head attached to the first end of the rod and extending away from the rod, wherein:

the cleaning head comprises a pocket that is configured to receive the distal ends of the stems, and an opening of the pocket is configured to receive the distal ends has a width that is wider than the width of the compressed position.

2. The cleaning tool of claim 1, wherein the rod further comprises a removable handle.

3. The cleaning tool of claim 1, wherein cleaning head further comprises:

a first face on which an abrasive scrubbing material is disposed, and a second face comprising a soft cleaning material that is pre-saturated with a cleaning solution, wherein the first face is opposite the second face.

4. The cleaning tool of claim 3, wherein the cleaning solution comprises an alcohol-free cleaning solution.

5. The cleaning tool of claim 3, wherein:

the soft cleaning material comprises a sponge, and the soft cleaning material of the cleaning head is pre-saturated with the cleaning solution in an amount that does not freely drip from the sponge.

6. The cleaning tool of claim 5, wherein an exterior surface of the sponge is covered by a fabric material.

7. The cleaning tool of claim 1, wherein the prongs, when positioned in the pocket, are urged against internal surfaces of the pocket to retain the cleaning head on the first end of the rod.

* * * * *